US008245786B2

(12) United States Patent
Ellis

(10) Patent No.: US 8,245,786 B2
(45) **Date of Patent: *Aug. 21, 2012**

(54) SYSTEM, METHOD AND APPARATUS FOR SLEEVED TENSIONER ROD WITH ANNULAR ADHESIVE RETENTION

(75) Inventor: Fife B. Ellis, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 119 days.

This patent is subject to a terminal disclaimer.

(21) Appl. No.: 12/750,415

(22) Filed: Mar. 30, 2010

(65) Prior Publication Data

US 2010/0183376 A1 Jul. 22, 2010

Related U.S. Application Data

(63) Continuation of application No. 11/732,320, filed on Apr. 3, 2007, now Pat. No. 7,686,085, which is a continuation-in-part of application No. 11/226,573, filed on Sep. 14, 2005.

(51) Int. Cl.
*E21B 7/12* (2006.01)

(52) U.S. Cl. ..... 166/355

(58) Field of Classification Search ..... 166/355, 166/303, 344, 258

See application file for complete search history.

(56) References Cited

U.S. PATENT DOCUMENTS

| | | | | |
|---|---|---|---|---|
| 4,379,657 | A * | 4/1983 | Widiner et al. | 405/224.4 |
| 4,759,256 | A * | 7/1988 | Kovit et al. | 91/29 |
| 4,787,778 | A * | 11/1988 | Myers et al. | 405/224.4 |
| 5,252,004 | A * | 10/1993 | Butler et al. | 405/211 |
| 5,477,771 | A * | 12/1995 | Black | 92/5 R |
| 5,628,586 | A * | 5/1997 | Arlt, III | 405/195.1 |
| 6,418,970 | B1 * | 7/2002 | Deul | 138/31 |
| 6,439,103 | B1 * | 8/2002 | Miller | 92/128 |
| 6,585,455 | B1 * | 7/2003 | Petersen et al. | 405/224.4 |
| 7,112,011 | B2 * | 9/2006 | McCarty et al. | 405/224.4 |
| 2003/0188875 | A1 * | 10/2003 | Bloom et al. | 166/382 |
| 2004/0079854 | A1 * | 4/2004 | Ma et al. | 248/631 |

* cited by examiner

*Primary Examiner* — Thomas Beach
*Assistant Examiner* — Aaron Lembo
(74) *Attorney, Agent, or Firm* — Bracewell & Giulani LLP

(57) ABSTRACT

A corrosion-resistant alloy tube is formed and bonded to a pre-machined steel alloy rod to form a riser tensional cylinder rod. During assembly, an epoxy is injected into an annular space between the tube and rod and then cured. The bonded tube is ground to a desired surface finish prior to installation and utilizes a double seal arrangement that prevents external pressure or corrosive fluids from entering the cured epoxy in the annular space.

14 Claims, 3 Drawing Sheets

SYSTEM, METHOD AND APPARATUS FOR SLEEVED TENSIONER ROD WITH ANNULAR ADHESIVE RETENTION

This application is a continuation-in-part of and claims priority to and the benefit of U.S. patent application Ser. No. 11/226,573 filed Sep. 14, 2005, entitled System, Method, and Apparatus for a Corrosion-Resistant Sleeve for Riser Tensioner Cylinder Rod, which is incorporated herein by reference.

BACKGROUND OF THE INVENTION

1. Technical Field

The present invention relates in general to offshore drilling rig riser tensioners and, in particular, to an improved system, method, and apparatus for corrosion-resistant riser tensioner cylinder rods having an outer sleeve retained with an annular layer of epoxy.

2. Description of the Related Art

Some types of offshore drilling rigs utilize "push-up" or "pull-up" type riser tensioners. The riser tensioner incorporates cylinder rods to maintain tension on the riser. The cylinder rods are subjected to a very corrosive environment caused by exposure to drilling muds, completion fluids, and general offshore environments. As a result, the rods currently being used are made from either a solid nickel-based alloy or a laser-clad cobalt-based layer that is applied to a steel alloy rod. Both of these current rod options are expensive and, in the case of cladding, result in long lead times with multiple process requirements in geographically remote locations. Consequently, there is a higher probability for damaged parts and scrap or scrappage. Thus, an improved design for riser tensioner cylinder rods would be desirable.

SUMMARY OF THE INVENTION

One embodiment of a system, method, and apparatus for improving the cylinder rods for riser tensioners. The present invention overcomes the shortcomings of the prior art by placing a thin tube or pipe over a pre-machined steel alloy rod. The tube is formed from a corrosion-resistant alloy and is bonded to the rod with, e.g., a thin layer of epoxy. This design results in a much lower manufacturing cost (approximately one-third less than current technology) and shorter manufacturing lead times. The manufacturing process for installing the sleeve requires injection and curing of the epoxy between the pipe and rod.

In one embodiment, the rod is machined with threaded end connections that serve to ultimately connect the rod assembly to the piston and rod extension of the cylinder assembly. The tubing is slid over the outer diameter of the rod and temporarily connected with two end connectors that center the tubing on the rod. The connectors also act as ports for injecting the epoxy which is pumped into the annular space on one end. The excess epoxy exits the opposite end and the retained epoxy is cured. The end connectors are then removed and the assembled part is ground to a final outer diameter before installation. The piston is connected and the rod clevis is made up to the cylinder rod and utilizes a double seal arrangement that prevents external pressure or corrosive fluids from entering the cured epoxy in the annular space. Advantageously, this process eliminates straightness and warping issues that commonly occur with prior art cladding operations.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
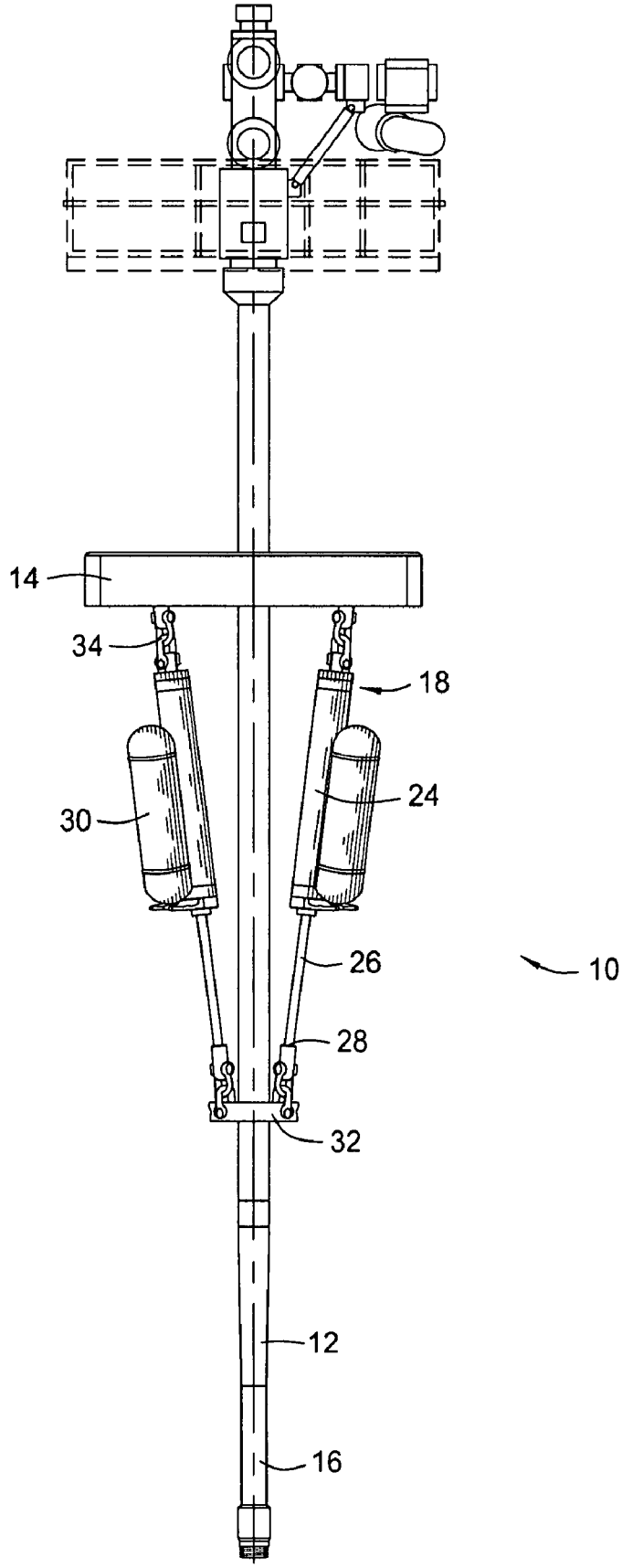
FIG. 1 is a partial sectional view of one type of floating platform with a riser supported by a tensioning mechanism constructed in accordance with the invention.

Referring to FIG. 1, one type of riser tensioning mechanism 10 is depicted. Although mechanism 10 is depicted as a "pull-up" type, one skilled in the art will recognize that the present invention is equally suitable for "push-up" type and other types of tensioning mechanisms.

A riser 12 extends downwardly from a platform 14 to a subsea wellhead (not shown). Riser 12 has a longitudinal axis 16 and is surrounded by a plurality of hydraulic cylinders 18. Each hydraulic cylinder 18 has a cylinder housing 24 having a chamber (not shown). A piston rod 26 has a rod end 28 that extends downward from each cylinder housing 24 and hydraulic cylinder 18. The piston ends of rods 26 opposite rod ends 28 are disposed within the respective chambers (not shown) of cylinder housings 24. Hydraulic fluid (not shown) is contained within the housing 24 for pulling piston rods 26 upward. Each hydraulic cylinder 18 also has accumulator 30 for accumulating hydraulic fluid from hydraulic cylinder 18 and for maintaining high pressure on the hydraulic fluid. A riser collar 32 rigidly connects to riser 12. The piston rods 26 attach to riser collar 32 at the rod ends 28. Cylinder shackles 34 rigidly connect cylinder housings 24 to platform 14.

In operation, the riser tensioning mechanism 10 pulls upward on riser 12 to maintain tension therein. Riser collar 32 connects to riser 12 and engages riser 12 below platform 14 and cylinder receiver 18. Hydraulic fluid pressure is applied to hydraulic cylinders 18 so that riser 12 is maintained in constant tension. Riser collar 32 supports the weight of riser 12 in order to create a tensional force in riser 12. Hydraulic cylinders 18 automatically adjust to changes in platform 14 position to allow for relative movement between riser 12 and platform 14. In the event of a failure in one of the four hydraulic cylinders 18, the remaining hydraulic cylinders 18 will continue to support riser 12 in tension without excessive bending moments being applied to the hydraulic cylinders 18.

Figure 2:
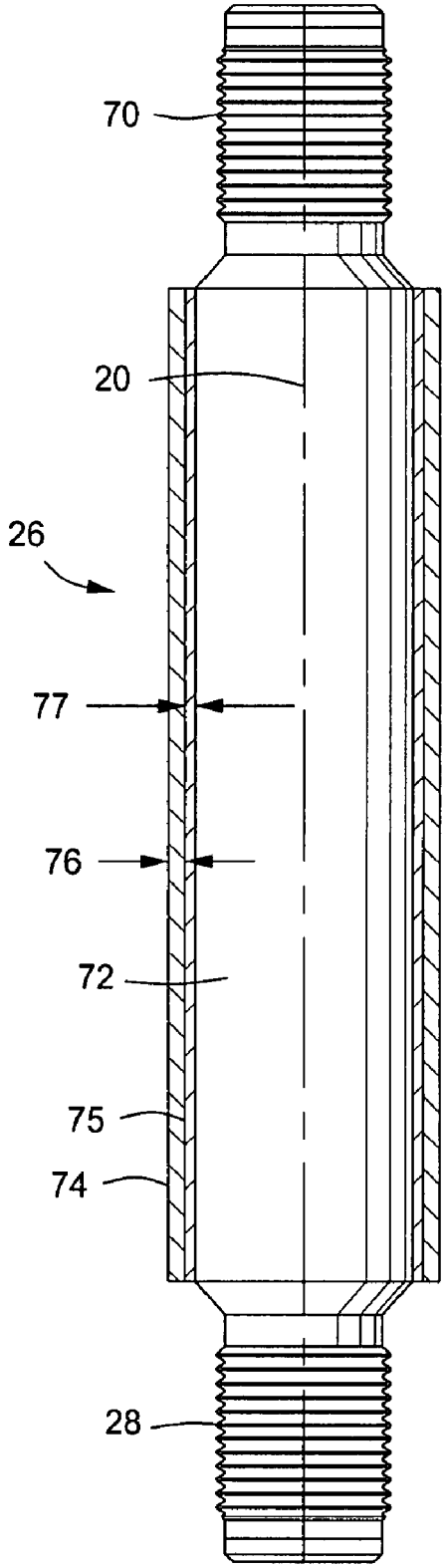
FIG. 2 is a partially sectioned side view of one embodiment of a piston rod for a riser tensioning mechanism and is constructed in accordance with the invention.

Referring now to FIG. 2, one embodiment of a piston rod 26 constructed in accordance with the present invention is shown. Piston rod 26 is the structural or load carrying member of the rod assembly, which includes a covering 74 and adhesive 75 that are shown greatly exaggerated in size for ease of understanding. Covering 74 serves as a barrier to protect the structural steel inner member from the outside corrosive fluids and atmospheric conditions typically found in offshore platforms.

As described above, piston rod 26 has axis 20 and includes a threaded rod end 28 for coupling with riser collar 32, and a piston end 70 that locates in and moves axially relative to cylinder housing 24. Piston rod 26 also comprises a solid shank 72 that extends and is located between ends 28, 70. Piston rod 26 is formed from a pre-machined steel alloy, such as commonly available inexpensive steel alloys that are not corrosion resistant.

In one embodiment, the outer surface of shank 72 is enveloped by and protected with a thin, corrosion-resistant material covering 74. In one embodiment, it is only shank 72 that is covered by covering 74. Covering 74 may have a radial thickness 76 in a range on the order of 0.005 to 1.0 inches. The covering 74 itself may comprise many different forms including a tube, pipe, coating, or still other suitable coverings for protecting piston rod 26 from corrosion.

A layer of adhesive 75 is located between covering 74 and shank 72. Adhesive 75, which may comprise epoxy or other bonding agents has a radial thickness 77 in a range on the order of approximately 0.0025 to 0.5 inches. The layer of epoxy serves to bond the sleeve to the outer diameter of the rod, and also to support or "back up" the thin sleeve from collapse due to external pressure while the rod translates in and out of the cylinder assembly under pressure.

Figure 3:
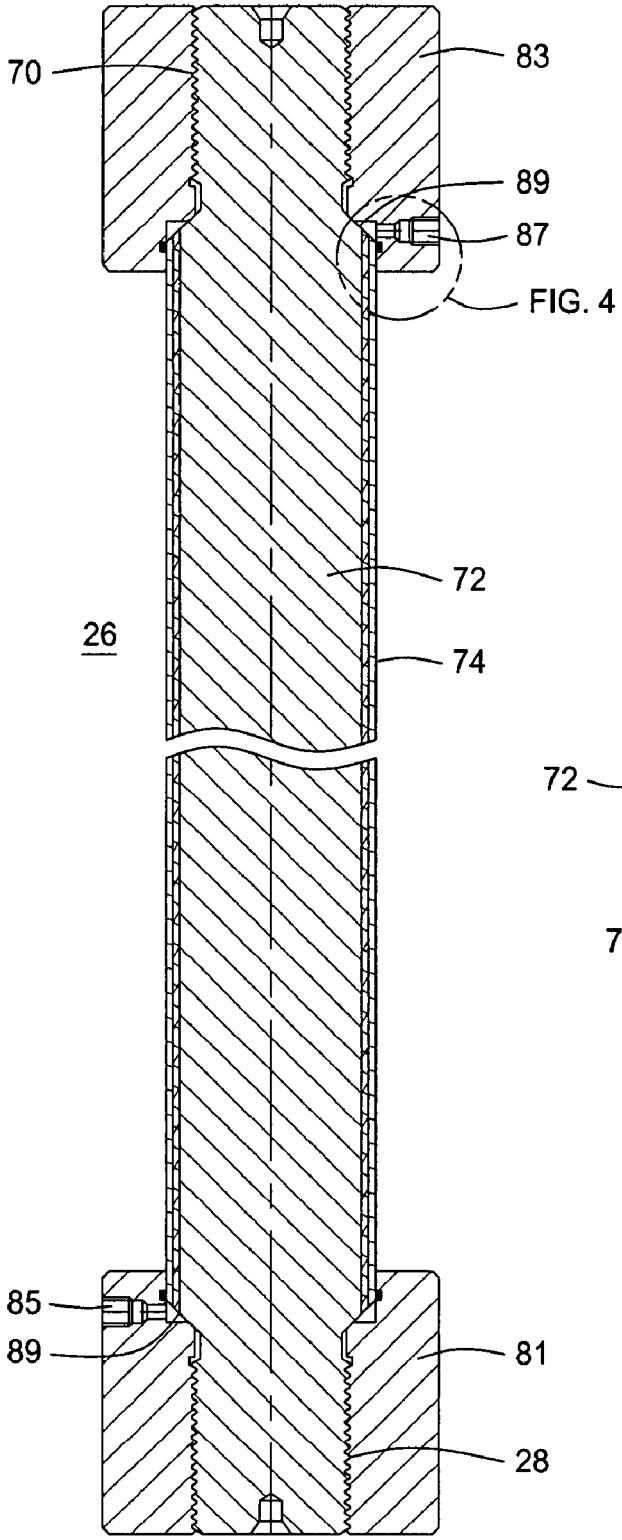
FIG. 3 is a sectional side view of one embodiment of a piston rod and end connectors for manufacturing thereof and is constructed in accordance with the invention.
Figure 4:
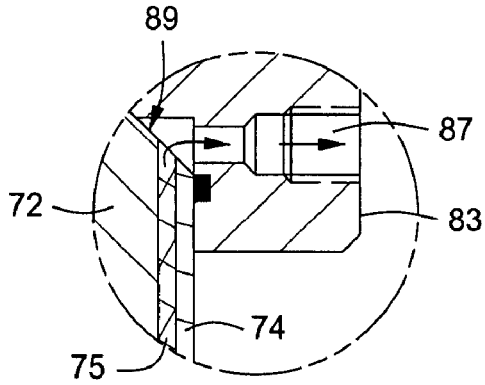
FIG. 4 is an enlarged sectional side view of one embodiment of a portion of the piston rod and one of the end connectors of FIG. 3 in accordance with the invention.

One embodiment of a method for joining covering 74 to piston rod 26 is depicted in FIGS. 3 and 4. In this embodiment, the covering 74 is formed from a thin tube 74 of corrosion-resistant alloy, such as nickel or cobalt-based alloys. Tube 74 may be joined to piston rod 26 via a series of operations. In one embodiment, a pre-cut length of tubing 74 is placed around the outer surface of shank 26. Tubing 74 closely receives the outer surface of shank 26, but forms a thin annular recess there between.

A set of end connectors 81, 83 are threadingly secured to the ends 28, 70 of piston rod 26. The annulus between tube 74 and shank 72 is sealed by end connectors 81, 83 at each end of piston rod 26. The end connectors 81, 83 serve to center the tube 74 relative to rod 26 and are provided with inlet and exit ports 85, 87, respectively. The inlet and exit ports 85, 87 are axially aligned with exterior tapers 89 formed between shank 72 and ends 28, 70 to provide fluid communication with the annulus.

In one embodiment, the annulus is pressurized via inlet port 85 with adhesive 75 which is pumped through the annulus before being released at exit port 87. The annulus is pressurized and/or metered with adhesive 75 to completely fill the annulus volume and remove all air pockets.

Alternatively, a vacuum may be formed between ports 85, 87 to evacuate the annulus and pull the adhesive through the annulus. The adhesive 75 is cured after annulus has been filled, and the end connectors 81, 83 are removed. Any necessary trimming of tube 74 is performed and the exterior surface of tube 74 is ground to a desired surface finish and outer diameter. The part may be ground between centers located at each end of the structural steel rod and following this operation is ready to be assembled into the cylinder. The piston is connected and the rod clevis is made up to the cylinder rod and utilizes a double seal arrangement that prevents external pressure or corrosive fluids from entering the cured epoxy in the annular space.

While the invention has been shown or described in only some of its forms, it should be apparent to those skilled in the art that it is not so limited, but is susceptible to various changes without departing from the scope of the invention. For example, although this embodiment is described with tubing only covering the shank, other embodiments may require greater or lesser surface coverage of the structural steel member.

What is claimed is:

1. A riser tensioning system, comprising:

a hydraulic cylinder:

a piston rod disposed within the hydraulic cylinder and extendable therefrom for supporting a riser from a platform, the piston rod comprising:

a body having an axis, a cylindrical shank, a threaded rod end joining a first end of the shank and located within the cylinder, and a threaded piston end joining a second end of the shank for coupling with a riser collar, the body being formed from a steel alloy;

a tubular covering on the shank of the body, the covering having an end flush with the second end of the shank, the covering being formed from a corrosion-resistant alloy for protecting the shank from corrosion, and the covering defining an annulus between the covering and the shank connected to a port; and a bonding material located between the shank and the tubular covering for the tubular covering to the shank injected via the port.

2. The riser tensioning system as recited in claim 1, wherein the tubular covering comprises a tube having a radial thickness in a range of 0.005 to 1.0 inches.

3. The riser tensioning system as recited in claim 1, wherein a length of the tubular covering is equal to a length of the shank of the body, and the covering has another end flush with the first end of the shank.

4. The riser tensioning system as recited in claim 1, wherein the tubular covering is formed from a material selected from the group consisting of nickel-based and cobalt-based alloys, the body is formed from a premachined steel alloy, and the bonding material is an epoxy.

5. The riser tensioning system as recited in claim 1, wherein the bonding material has a radial thickness in a range of approximately 0.0025 to 0.5 inches

6. A method of fabricating a piston rod for a riser tensioner system, comprising:

(a) providing a structural steel member;

(b) placing a tube around the structural steel member to form a subassembly and define an annulus between the tube and the structural steel member;

(c) securing and sealing end connectors to the subassembly;

(d) injecting an adhesive into the annulus via the end connectors; then (e) curing the adhesive and then removing the end connectors to form an assembly.

7. A method according to claim 6, wherein step (a) comprises providing the structural steel member as a non-corrosion resistant alloy, and step (b) comprises providing the tube as a corrosion resistant alloy.

8. A method according to claim 6, wherein step (d) comprises one of pressurizing and evacuating the annulus to inject the adhesive.

9. A method according to Claim 6, wherein step (b) comprises positioning the tube only around an outer surface of a shank of the structural steel member and centering the tube with respect to the shank.

10. A method according to claim 6, wherein step (c) comprises threadingly securing the end connectors to the subassembly.

11. A method according to claim 6, wherein the tube is formed from a material selected from the group consisting of nickel-based and cobalt-based alloys.

12. A method according to claim 6, wherein step (d) comprises completely filling the annulus with the adhesive to remove all air pockets in the annulus.

13. A method according to claim 6, further comprising grinding an exterior surface of the assembly to a desired surface finish and outer diameter.

14. A method of fabricating a riser tensioner system, comprising:

providing a structural steel member;

placing a tube around the structural steel member to form a subassembly and define an annulus between the tube and the structural steel member;

securing and sealing end connectors to the subassembly;

injecting an adhesive into the annulus via the end connectors;

curing the adhesive and then removing the end connectors to form a piston rod assembly; and disposing the piston rod assembly into a hydraulic cylinder.

* * * * *